United States Patent [19]

Warp et al.

[11] 4,000,803

[45] Jan. 4, 1977

[54] VACUUM-BUFFERED BIDIRECTIONAL PAPER DRIVE SYSTEM

[75] Inventors: Rick A. Warp, San Diego; John L. Morton, Jr., Escondido; Majid Azmoon, San Diego, all of Calif.

[73] Assignee: Hewlett-Packard Company, Palo Alto, Calif.

[22] Filed: Jan. 21, 1976

[21] Appl. No.: 650,839

[52] U.S. Cl. ..... 197/133 R; 226/78; 226/85; 226/195

[51] Int. Cl.[2] ..... B65H 23/24; B65J 15/00

[58] Field of Search ..... 226/7, 76, 78, 85, 95, 226/108, 181, 195; 197/133 R, 133 P; 346/136, 141

[56] References Cited

UNITED STATES PATENTS

| | | | |
|---|---|---|---|
| 3,259,288 | 7/1966 | Wassermann | 226/195 |
| 3,460,158 | 8/1969 | Bravenec | 226/195 |
| 3,606,123 | 9/1971 | Hakanson | 226/195 |
| 3,961,335 | 6/1976 | Gordon | 346/136 |

*Primary Examiner*—Robert W. Saifer

*Attorney, Agent, or Firm*—A. C. Smith; Robert S. Hulse

[57] ABSTRACT

A printer-plotter system includes a vacuum-buffered bidirectional paper drive system for moving paper uniformly forward and backward over a sprocketed platen and sprocketed drum. The platen comprises a stationary portion with a flat region and a rotatable sprocketed portion. The platen and drum are connected by a drive belt for synchronous rotation of the drum with the sprocketed portion of the platen to assure proper contact of a print head with the flat region of the stationary portion and proper movement of paper by the sprocketed portion after printing.

12 Claims, 4 Drawing Figures

VACUUM-BUFFERED BIDIRECTIONAL PAPER DRIVE SYSTEM

BACKGROUND OF THE INVENTION

The present invention relates generally to printer-plotter systems and, more particularly, to printer paper drive systems. Certain known apparatus for driving or transporting paper includes a pair of sprocketed rollers which receive paper on the top edges of the rollers, and includes a vacuum chamber located beneath the paper and between the rollers for applying tension to the paper. One such apparatus is the Model 1200 or 1240 Plotter distributed by Zeta Research Company of Lafayette, California. One problem encountered with apparatus of this type is that paper buckling often occurs when the force applied to the paper by a print head with a high coefficient of friction therebetween causes substantial frictional drag on the paper.

SUMMARY OF THE INVENTION

In accordance with the preferred embodiment of the present invention, a vacuum-buffered bidirectional paper drive system includes a drum roller with sprocketed end portions and a platen roller having a stationary portion and rotatable sprocketed end portions, and a pair of lateral boundary members each running from the edge of one roller to the corresponding edge of the other roller. The platen and drum are connected by a drive belt for synchronous bidirectional rotation of the surface of the drum with the surface of the sprocketed end portions of the platen. To permit intimate contact by a print head with the stationary portion of the platen, the stationary portion has a flat region running horizontally from one end of the stationary portion to the other. A web or continuous sheet of paper is attached to the platen and drum by the respective sprocket drives and follows a course from the bottom of the drum, around the platen and back, to the top of the drum. The paper, platen, drum, and associated lateral boundary members form a vacuum chamber which is connected to a suitable vacuum source for maintaining tension in the paper. This prevents buckling or detrimental frictional drag when the force applied by a print head is high.

DESCRIPTION OF THE PREFERRED EMBODIMENT

Figure 1:
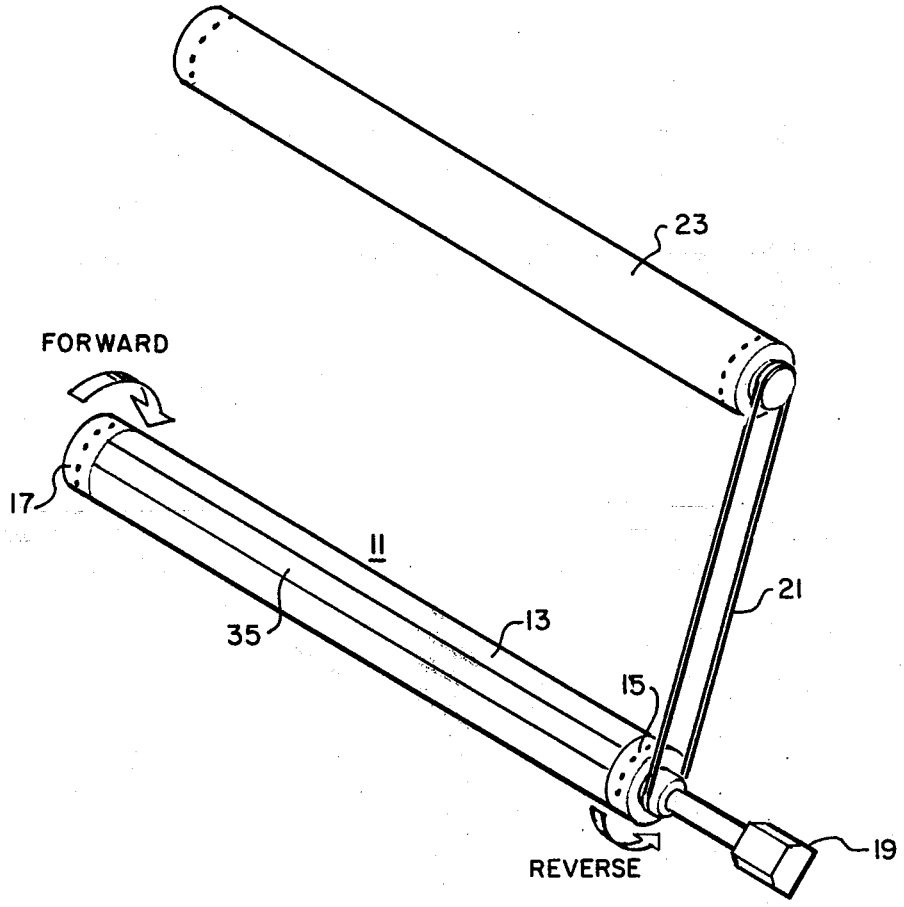
FIG. 1 is a diagrammatic illustration of a belt-driven platen and roller of the paper drive system of the present invention.
Figure 2:
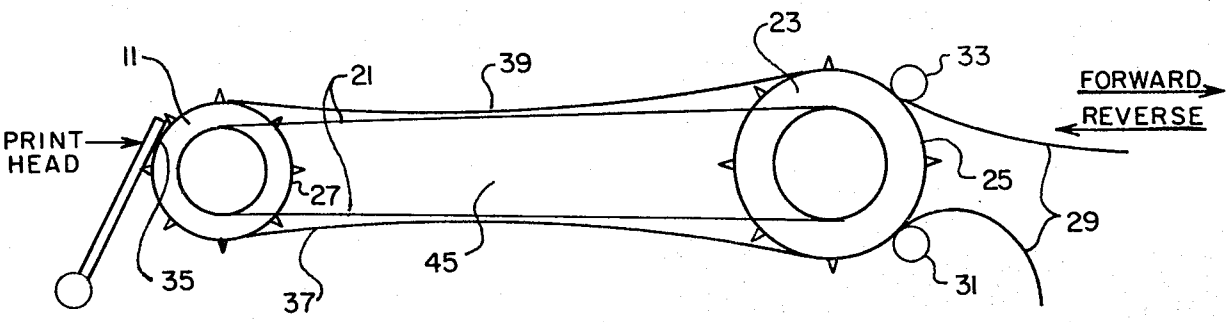
FIG. 2 is a diagrammatic illustration of a side view of the system of FIG. 1.

Referring now to FIG. 1, there is shown a platen 11 having a stationary portion 13 and rotatable sprocketed end portions 15, 17 that are driven by a drive motor 19 which is also connected by a drive belt 21 to a sprocketed cylindrical roller or drum 23. As shown in FIGS. 1 and 2, the drive belt 21 permits synchronous bidirectional rotation at identical surface velocities of the drum 23 and the sprocketed end portions 15, 17 of the platen 11.

Paper 29 in continuous sheet form, with sprocket holes punched at periodic locations along both edges, feeds into the system from the top or the bottom of drum 23, depending upon the desired direction of paper movement. The paper moves along a path past the bottom of drum 23 where it is held in contact with the bottom portion of drum 23 by idler 31, then over and around part of the cylindrical surface area or face of platen 11, then over the top portion of drum 23 and under idler 33. Successive pairs of holes in the paper fit over successive pairs of sprockets on the end portions 15, 17 of the platen 11 and on the drum 23, causing the paper to move uniformly in either forward or reverse direction as the drum 23 and the sprocketed end portions 15, 17 of platen 11 rotate in a forward or reverse direction. As shown in FIG. 1, a flat surface region 35 is cut into the cylindrical surface of the stationary portion 13 of platen 11 to permit intimate contact of a flat print head with paper passing over the platen 11, as shown in FIG. 2.

Figure 3:
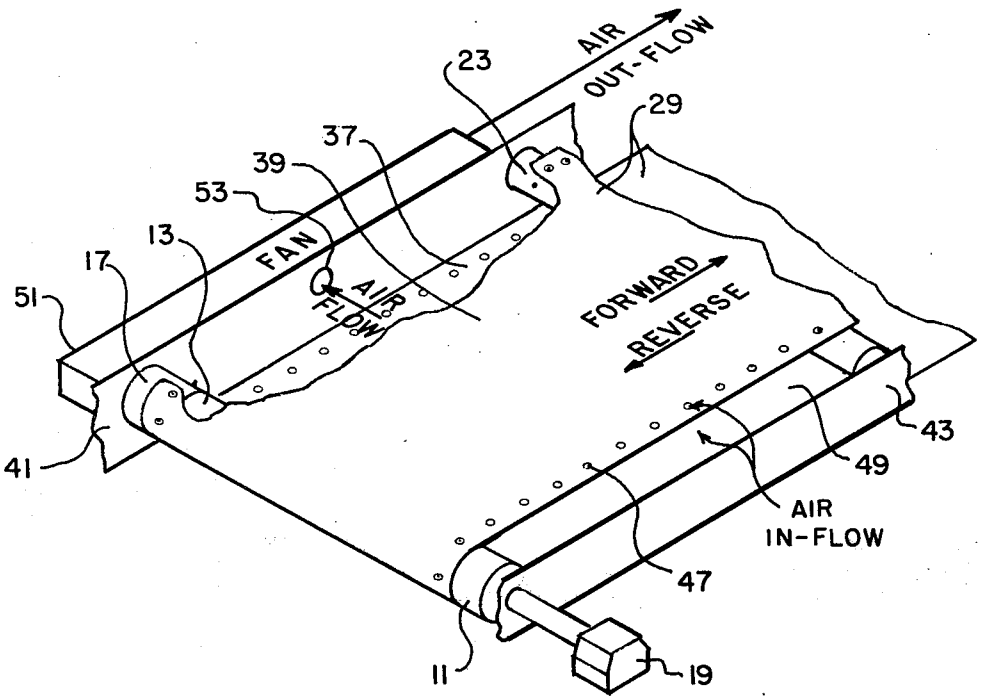
FIG. 3 is a cut-away top view of the system of FIG. 1 shown having a vacuum chamber and a fan disposed outside the chamber.
Figure 4:
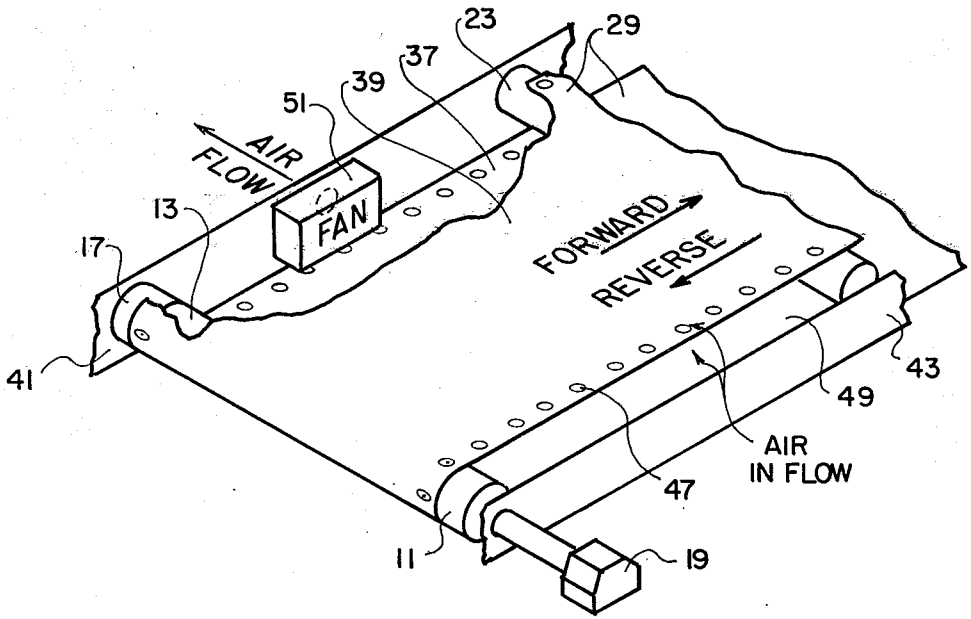
FIG. 4 is a cut-away top view of the system of FIG. 1 showing a fan disposed inside the vacuum chamber.

Referring now to FIGS. 2 and 3, it can be seen that the upper section 39 and lower section 37 of paper 29, together with platen 11, drum 23, and lateral boundary members 41 and 43, form vacuum chamber 45. Air enters the chamber 45 primarily through the holes 47 in paper 29 and through the space 49 between the sides of the paper 29 and lateral boundary members 41 and 43. A fan 51, disposed outside the chamber 45, produces a vacuum or other pressure differential by exhausting the air in the chamber 45 through a vent or hole 53 in lateral boundary member 41. This pressure differential acts on both upper and lower sections 39, 37 of paper 29 to maintain substantially uniform tension in the paper 29 across the entire face of platen 11. The fan 51 or other means for producing a fluid pressure differential within the chamber 45 relative to the surrounding ambient fluid pressure may be alternatively disposed on the inside wall of lateral boundary member 41 coupled to the hole 53.

We claim:

1. A web driving system comprising:

platen means having at least end portions which are rotatable about a common axis and which are disposed to receive a web to be driven with substantial wrap thereabout;

roller means disposed to rotate about an axis which is spaced from, and which is parallel to, and coplanar with, said common axis for receiving and delivering a web which is wrapped about the platen means and which contacts said roller means on substantially oppositely disposed portions of the circumference of said roller means;

drive means coupled to said end portions and to said roller means for selective rotation thereof at identical surface velocities;

a pair of boundary means laterally disposed adjacent opposite ends of the roller means and said end portions to traverse the spacing therebetween for forming boundaries of a chamber; and means cooperating with the chamber formed by said pair of boundary means, said platen means, and said roller means and by a web being driven thereby, for producing a fluid pressure differential within said chamber relative to ambient fluid pressure for maintaining tension in said web about said platen means and between said platen means and roller means.

2. The system of claim 1 wherein said roller means includes a pair of idler means disposed to hold a web being driven in close contact with substantially oppositely disposed portions of the surface of said roller means.

3. The system of claim 1 wherein said platen means comprises a stationary center portion between said rotatable end portions.

4. The system of claim 3 wherein said stationary center portion of the platen means includes a flat region on the surface thereof for permitting proper contact between a print head and a portion of a web traversing the flat region of the platen means.

5. The system of claim 1 wherein each of said end portions of said platen means includes sprockets circumferentially disposed on its surface for engaging and imparting a drive force to a web.

6. The system of claim 5 wherein said roller means includes sprockets circumferentially disposed on its surface at the ends of said roller means for engaging and imparting a drive force to said web in synchronism with the sprocketed end portions of said platen means.

7. The system of claim 5 wherein the web is a continuous sheet of paper having mating sprocket holes disposed along the edges thereof.

8. The system of claim 1 wherein said pair of boundary means are disposed to form minimum space between the edges of a web and said boundary means.

9. The system of claim 8 wherein one of said pair of boundary means includes a vent therein coupled to said means for producing a fluid pressure differential within said chamber for transferring fluid therethrough with respect to said chamber.

10. The system of claim 9 wherein said means for producing a fluid pressure differential within said chamber is disposed within said chamber and is attached to one of said boundary means adjacent to said vent in said boundary means.

11. The system of claim 10 wherein said means for producing a fluid pressure differential within said chamber is disposed external to said chamber and is coupled to said vent in said boundary means for reducing the fluid pressure within said chamber.

12. The system of claim 1 wherein said drive means includes a belt connecting the end portions of said platen means and said roller means for synchronous rotation of the surfaces of the rotatable end portions of said platen means with the surface of said roller means.

* * * * *